US005080048A

United States Patent [19]

Kudo

[11] Patent Number: 5,080,048

[45] Date of Patent: Jan. 14, 1992

[54] POWER BLOWER

[75] Inventor: Hiroshi Kudo, Iwate, Japan

[73] Assignee: Kioritz Corporation, Tokyo, Japan

[21] Appl. No.: 696,650

[22] Filed: May 7, 1991

[30] Foreign Application Priority Data

May 9, 1990 [JP] Japan ..... 2-48379[U]

[51] Int. Cl.[5] ..... F01P 7/04

[52] U.S. Cl. ..... 123/41.64; 15/405; 60/317; 181/225

[58] Field of Search ..... 123/41.63, 41.64, 41.65, 123/41.7; 60/316, 317, 321; 15/405, 406, 407, 408, 330; 181/224, 225, 227, 228

[56] References Cited

U.S. PATENT DOCUMENTS 4,060,985 12/1977 Fukushima ..... 123/41.64
4,809,502 3/1989 Iida et al. ..... 60/316
4,872,308 10/1989 Nagai et al. ..... 60/316
4,913,112 4/1990 Iida ..... 123/41.65

*Primary Examiner*—Noah P. Kamen
*Attorney, Agent, or Firm*—Browdy and Neimark

[57] ABSTRACT

A tail pipe of an exhaust muffler of an internal combustion engine extends and terminates in a delivery opening to which air blown from a blower is flowed, and an exhaust vent of the tail pipe is disposed so as to open in a downstream direction of the air blown from the delivery opening.

1 Claim, 2 Drawing Sheets

POWER BLOWER

BACKGROUND OF THE INVENTION

The present invention relates to a power blower.

Power blowers are machines used for blowing air as in cleaning or in spraying chemicals. The power blower is typically equipped with a small air-cooled two cycle internal combustion engine and a blower in a housing thereof. Power from the internal combustion engine drives the blower to blow out air through a delivery pipe connected to a delivery opening of the blower. In such a power blower, conventionally, exhaust gas emitted from the internal combustion engine passes through an exhaust muffler, and then is discharged directly to the atmosphere. As a result, especially with a portable power blower, there is a great deal of noise caused when the exhaust gas is discharged, making it unpleasant for the worker, coworkers, and others nearby. In the case of a two cyle internal combustion engine, particularly irritating is the intermittent noise produced by and peculiar to the two cycle internal combustion engine. Another disadvantage is that if the exhaust muffler is satisfactorily constructed so as to reduce the unpleasant noise made during the gas discharge, the output of the internal combustion engine is lowered.

SUMMARY OF THE INVENTION

The object of the present invention is therefore to provide a convenient and simply-structured power blower which eliminates such problems of the conventional art.

The present invention provides a power blower having, in a housing thereof, an internal combustion engine and a blower driven by the internal combustion engine, wherein a tail pipe of an exhaust muffler of the internal combustion engine extends and terminates in a delivery opening to which air blown from the blower is flowed, an exhaust vent of the tail pipe being disposed so as to open in a downstream direction of the air blown from the delivery opening.

Noise caused by the internal combustion engine during the discharge of exhaust gas is damped when the exhaust gas emitted from the internal combustion engine passes through the exhaust muffler. The exhaust gas is then discharged through the tail pipe to the delivery opening of the blower, and is mixed with air blown from the blower before being released in to the atmosphere. The noise is thus further damped when the exhaust gas passes through the tail pipe. Noise caused by the internal combustion engine during discharge of the exhaust gas, particularly intermittent noise peculiar to the two cycle engine, can be markedly reduced, without enlarging the size of the exhaust muffler, or lowering the output of the internal combustion engine. It is also possible to change the property of the sound of the noise. Moreover, since an air flow blown from the blower cools the tail pipe of the exhaust muffler, it prevents the tail pipe from being overheated. Components near the muffler are not adversely affected by heat.

PREFERRED EMBODIMENT OF THE INVENTION

Figure 1:
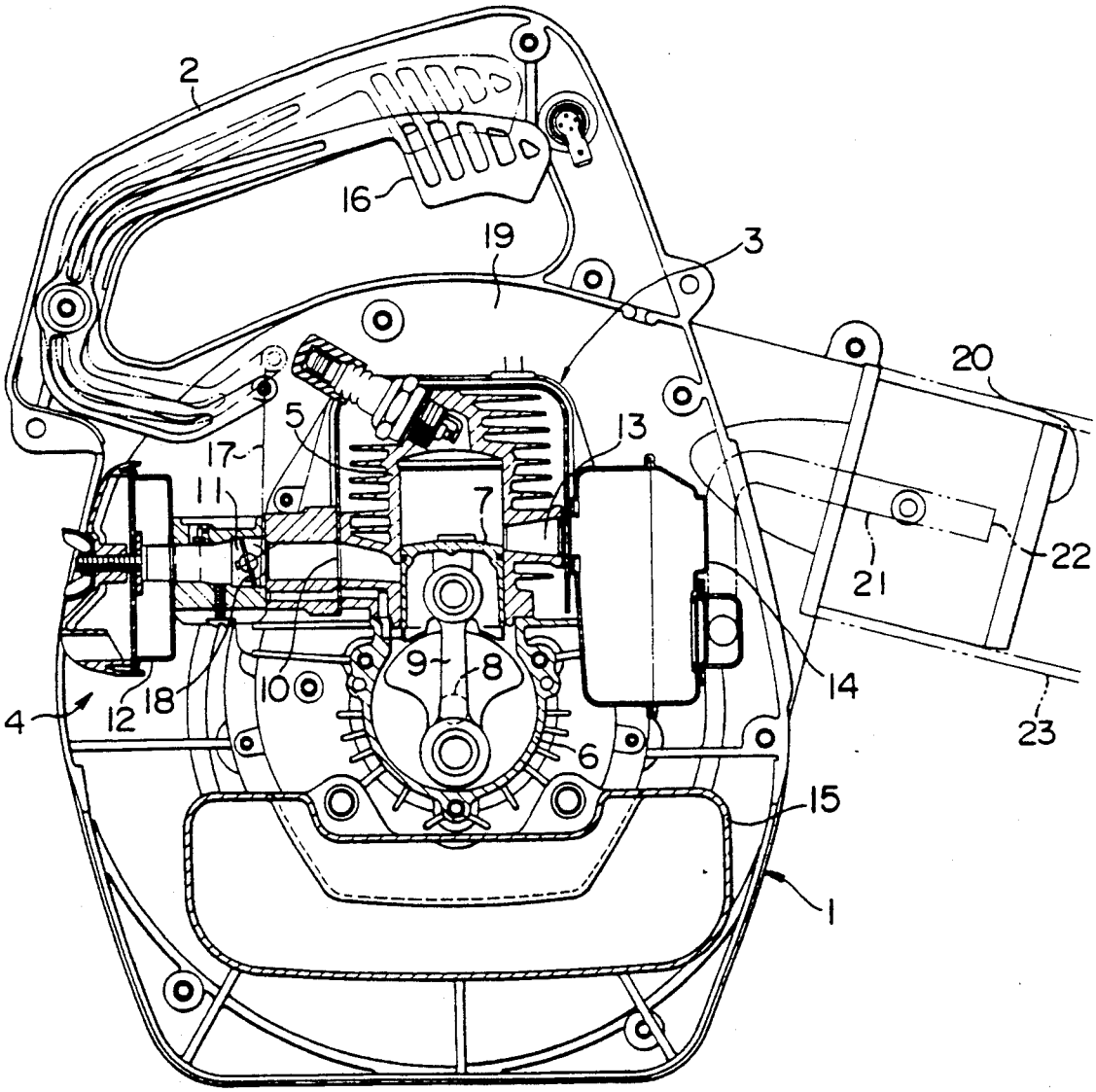
FIG. 1 is a vertical sectional side view of a power blower showing an embodiment according to the present invention.

The present invention will be described below based on an embodiment shown in the drawings.

The embodiment shown in the drawings is a portable power blower to which this invention is applied. As shown in FIG. 1, a handle 2, which the worker can grasp, is affixed integrally to an upper portion of a housing 1. An internal combustion engine 3 and a centrifugal blower 4 are arranged inside the housing 1. In this embodiment, the internal combustion engine 3 is a small air-cooled two cycle engine. A cylinder 5 and a crank case 6 connected to a lower end of the cylinder 5 are also arranged in the housing 1. A piston 7 reciprocating in the cylinder 5 is coupled via a connecting rod 9 to a crankshaft 8 rotatably supported in the crank case 6. The cylinder 5 has a suction port 10 on one side of the cylinder 5, this suction port 10 being used for taking in air mixed with fuel from a carburetor 11. The carburetor 11 is connected to an air cleaner 12, and sucks air outside after the air has been cleaned by the air cleaner 12. An exhaust port 13 is formed on the other side of the cylinder 5 to discharge exhaust gas emitted from the cylinder 5 to an exhaust muffler 14. A fuel tank 15 is provided at the bottom of the housing 1, and is used for storing a fuel consumed by the internal combustion engine 3. A throttle trigger 16 is provided at the handle 2, being connected by a linkage 17 to a throttle valve 18 of the carburetor 11. While grasping the handle 2, the worker can operate the throttle trigger 16 to control the actuation of the internal combustion engine 3.

Figure 2:
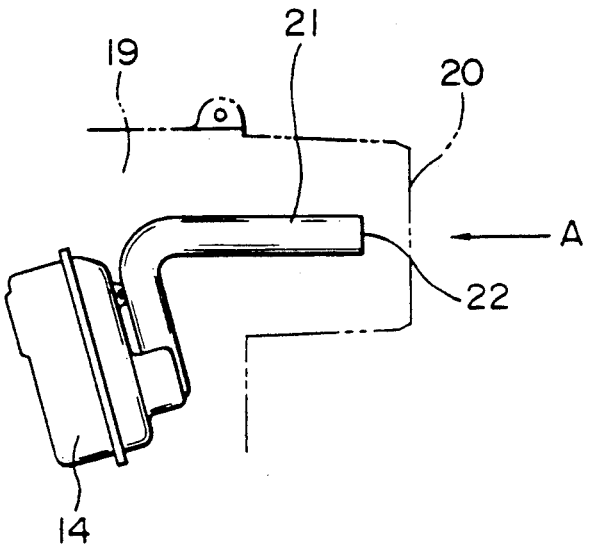
FIG. 2 is a view used for explaining an exhaust muffler and a delivery opening of the power blower illustrated in FIG. 1.
Figure 3:
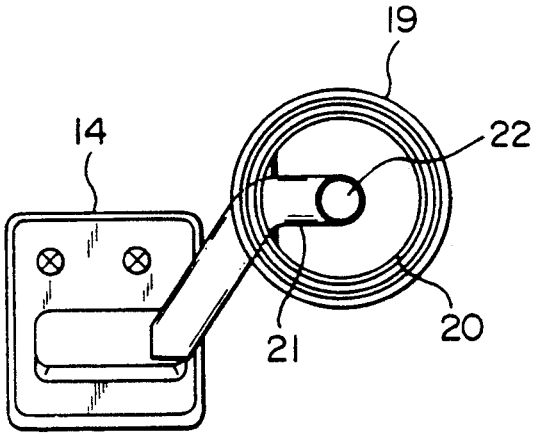
FIG. 3 is an end view as seen from the direction indicated by arrow A in FIG. 2.

A rotary impeller (not shown) of the centrifugal blower 4 is connected to the crankshaft 8 of the internal combustion engine 3. A blower volate casing 19 is formed around the impeller. A delivery pipe 23 made of, for instance, plastic is connected to a delivery opening 20 of the blower volute casing 19. Air blown is discharged through the end (not shown) of this delivery pipe 23. The exhaust muffler 14 and the delivery opening 20 of the blower volute casing 19 (of the blower 4) are disposed relatively close to each other. As shown in FIGS. 2 and 3, a tail pipe 21 of the exhaust muffler 14 penetrates the side wall of the blower volute casing 19 near the delivery opening 20, terminating in the inside of the delivery opening 20. An exhaust vent 22 of the tail pipe 21 is open at the center of the delivery opening 20 in the downstream direction of the air which is blown through the delivery opening 20.

In such a construction, exhaust gas emitted from the exhaust port 13 of the cylinder 5 in the internal combustion engine 3 is discharged into the exhaust muffler 14, and is further discharged from the tail pipe 21 of the exhaust muffler 14 to the delivery opening 20 of the blower volute casing 19 (of the centrifugal blower 4). In the delivery opening 20, the exhaust gas is mixed with an air flown from the blower volute casing 19, and then passes through the delivery pipe 23, connected to the delivery opening 20, and released in to the atmosphere. Thus, since the blown air flow as well as the exhaust muffler 14 damps the noise caused by the internal combustion engine 3, it is possible to greatly reduce the level of noise reaching the worker, without enlarging the size of the exhaust muffler 14 or lowering the output of the internal combustion engine 3. Also, the intermittent noise peculiar to two cycle internal combustion engines can be eliminated, and instead the property of sound of noise is less irritating. Moreover, the tail pipe 21 of the exhaust muffler 14 is cooled by air blown from the blower 14, so that it is prevented from being overheated. Components, such as the housing 1, near the tail pipe 21 are not adversely affected (e.g., the components are not softened by heat, nor are they melted). In addition, because the exhaust gas is mixed with the blown air to the fullest extent before being discharged to the outside, the temperature at which it is discharged can be decreased. This helps to extinguish sparks generated when the exhaust gas is discharged.

What is claimed is:

1. A power blower having, in a housing thereof, an internal combustion engine and a blower driven by said internal combustion engine, wherein a tail pipe of an exhaust muffler of said internal combustion engine extends and terminates in a delivery opening to which air blown from said blower is flowed, an exhaust vent of said tail pipe being disposed so as to open in a downstream direction of the air blown from said delivery opening.

* * * * *